US010704131B2

(12) United States Patent
Nishizawa et al.

(10) Patent No.: US 10,704,131 B2
(45) Date of Patent: Jul. 7, 2020

(54) CONTINUOUS HOT-DIP METAL PLATING DEVICE AND CONTINUOUS HOT-DIP METAL PLATING METHOD

(71) Applicant: NIPPON STEEL & SUMITOMO METAL CORPORATION, Tokyo (JP)

(72) Inventors: Koichi Nishizawa, Tokyo (JP); Masaaki Omodaka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 37 days.

(21) Appl. No.: 16/082,826

(22) PCT Filed: Mar. 24, 2017

(86) PCT No.: PCT/JP2017/012050
§ 371 (c)(1),
(2) Date: Sep. 6, 2018

(87) PCT Pub. No.: WO2017/170239
PCT Pub. Date: Oct. 5, 2017

(65) Prior Publication Data

US 2019/0085437 A1 Mar. 21, 2019

(30) Foreign Application Priority Data

Mar. 29, 2016 (JP) ..... 2016-065719

(51) Int. Cl.
*C23C 2/00* (2006.01)
*C23C 2/40* (2006.01)
(Continued)

(52) U.S. Cl.
CPC ..... *C23C 2/003* (2013.01); *C23C 2/06* (2013.01); *C23C 2/14* (2013.01); *C23C 2/40* (2013.01)

(58) Field of Classification Search
CPC ..... C23C 2/003; C23C 2/40
See application file for complete search history.

(56) References Cited

U.S. PATENT DOCUMENTS

| | | | |
|---|---|---|---|
| 5,538,559 | A | 7/1996 | Kleimeyer et al. |
| 2001/0022156 | A1 | 9/2001 | Iida et al. |
| 2003/0077397 | A1 | 4/2003 | Kabeya et al. |

FOREIGN PATENT DOCUMENTS

| | | | |
|---|---|---|---|
| CN | 101796209 | A | 8/2010 |
| JP | 6-81094 | A | 3/1994 |

(Continued)

OTHER PUBLICATIONS

International Preliminary Report on Patentability and English translation of the Written Opinion of the International Searching Authority, dated Oct. 2, 2018, issued in PCT/JP2017012050 (Forms PCT/IB/373 and PCT/ISA/237).

(Continued)

*Primary Examiner* — Binu Thomas
(74) *Attorney, Agent, or Firm* — Birch, Stewart, Kolasch & Birch, LLP

(57) ABSTRACT

A continuous hot-dip plating machine includes: a sink roll provided in a plating bath and configured to upwardly change a transfer direction of the steel strip; a first support roll provided in the plating bath and located above the sink roll, the first support roll being in contact with a first surface of the steel strip in contact with the sink roll; and a second support roll provided in the plating bath and located above the first support roll, the second support roll being in contact with a second surface of the steel strip opposite the first surface. A diameter of the first support roll, a diameter of the second support roll, and a vertical distance between a rotation axis of the first support roll and a rotation axis of the second support roll satisfy specific conditions.

3 Claims, 10 Drawing Sheets

(51) Int. Cl.
*C23C 2/14* (2006.01)
*C23C 2/06* (2006.01)

(56) References Cited

FOREIGN PATENT DOCUMENTS

| | | | | |
|---|---|---|---|---|
| JP | 6-128711 | A | | 5/1994 |
| JP | 2003-73791 | A | | 3/2003 |
| JP | 2003073791 | A | * | 3/2003 |
| JP | 2008280584 | A | * | 11/2008 |
| KR | 2003-0054523 | A | | 7/2003 |
| TW | 282424 | B | | 8/1996 |
| TW | 460615 | B | | 10/2001 |
| TW | 575685 | B | | 2/2004 |
| TW | 593746 | B | | 6/2004 |
| TW | 201313912 | A1 | | 4/2013 |

OTHER PUBLICATIONS

International Search Report for PCT/JP2017/012050 dated May 16, 2017.
Notice of Allowance for TW 106110362 dated Sep. 19, 2017.
Written Opinion of the International Searching Authority for PCT/JP2017/012050 (PCT/ISA/237) dated May 16, 2017.
Chinese Office Action and Search Report dated Dec. 19, 2019 for Application No. 201780015994.6, along with an English translation of the Office Action.
Extended European Search Report for corresponding European Application No. 17774776.3, dated Oct. 14, 2019.

* cited by examiner

CONTINUOUS HOT-DIP METAL PLATING DEVICE AND CONTINUOUS HOT-DIP METAL PLATING METHOD

CROSS REFERENCE TO RELATED APPLICATIONS

This application is the National Phase of PCT International Application No. PCT/JP2017/012050, filed on Mar. 24, 2017, which claims priority under 35 U.S.C. § 119(a) to Patent Application No. 2016-065719, filed in Japan on Mar. 29, 2016, all of which are hereby expressly incorporated by reference into the present application, in their entirety.

TECHNICAL FIELD

The present invention relates to a continuous hot-dip plating machine and a continuous hot-dip plating method.

BACKGROUND ART

A continuous hot-dip plating machine is configured to coat a metal strip such as a steel strip with a molten metal such as zinc. The continuous hot-dip plating machine includes rolls disposed in a plating tank storing the molten metal, the rolls including a sink roll for changing a transfer direction of a metal strip, and a pair of support rolls for flattening the shape of the metal strip. The transfer direction of the metal strip diagonally introduced into the plating bath is vertically upwardly changed by the sink roll. The metal strip then passes through between the pair of support rolls to be pulled out of the plating bath. Subsequently, gas is blown onto the surface of the metal strip from gas wiping nozzles disposed at both sides of the metal strip to wipe off extra molten metal adhered on the surface of the pulled-up metal strip, thereby adjusting deposited mass of the molten metal (occasionally referred to as "coating weight" hereinafter).

When the shape of the metal strip is not sufficiently flattened by the support rolls, the metal strip is warped in a width direction of the metal strip after passing through between the support rolls. In this case, since the distance between the gas wiping nozzles and the metal strip varies across the width direction of the metal strip, impingement pressure of the gas against the metal strip becomes uneven in the width direction, thereby possibly making coating weight non-uniform. In order to restrain the coating weight from becoming non-uniform during the continuous hot-dip plating, there have been proposed techniques for flattening the shape of the metal strip using the support rolls.

For instance, it is disclosed in Patent Literature 1 that, in order to inexpensively provide a roll device in a hot-dip plating bath capable of producing a hot-dip steel sheet that is excellent in uniformity of deposited mass of plating by simultaneously eliminating non-uniformity of the plating in both thickness and length directions of the hot-dip steel sheet, at least one of the support rolls positioned immediately above the sink roll is provided by a non-driven roll and a position(s) of at least one of the sink roll and the support rolls is horizontally adjustable.

CITATION LIST

Patent Literature(s)

Patent Literature 1 JP 6-128711 A

SUMMARY OF THE INVENTION

Problem(s) to be Solved by the Invention

However, in a typical continuous hot-dip plating, scratches and/or defects sometimes occur on the surface of the metal strip at a contact portion between the metal strip and the support rolls. For instance, when a steel strip is used as the metal strip, scratches and/or defects may occur on the surface of the hot-dip steel sheet due to dross (intermetallic compound generated in the plating bath). Specifically, the surface of the steel strip would have roll scratches, which occur by transfer of the dross adhered on the support rolls to the steel strip, and dross defects, which occur by the dross caught between the steel strip and the support rolls to be adhered to the steel strip. In addition, slip scratches may occur by a slip of the support rolls. Accordingly, in order to improve the quality of the hot-dip steel sheet, prevention of the scratches and/or defects on the surface of the hot-dip steel sheet is demanded in addition to enhancement in the uniformity of the coating weight.

The invention has been made in view of the above problems. An object of the invention is to provide a novel and improved continuous hot-dip plating machine and continuous hot-dip plating method capable of improving the quality of the hot-dip steel sheet by preventing the scratches and/or defects on the surface of the hot-dip steel sheet.

Means for Solving the Problem(s)

In order to solve the above problems, a continuous hot-dip plating machine according to an aspect of the invention includes: a plating bath; a sink roll provided in the plating bath and configured to upwardly change a transfer direction of a steel strip; a first support roll provided in the plating bath, the first support roll being positioned above the sink roll and in contact with a first surface of the steel strip in contact with the sink roll; and a second support roll provided in the plating bath, the second support roll being positioned above the first support roll and in contact with a second surface of the steel strip opposite the first surface, where a diameter of the first support roll, a diameter of the second support roll, and a vertical distance between a rotation axis of the first support roll and a rotation axis of the second support roll satisfy conditions represented by formulae (1) to (4) below,

[Formula 1]

$$D = D2 - 0.376D1 \tag{1}$$

$$420 - 0.839L \le D \le 445 - 0.655L \tag{2}$$

$$D1 \ge 210 \tag{3}$$

$$D1 + D2 \le 1000 - 2L + 2\left(20 - \sqrt{\frac{D1}{2}}\right)^2 \tag{4}$$

where:

D1 represents the diameter (mm) of the first support roll,

D2 represents the diameter (mm) of the second support roll, and

L represents the vertical distance (mm) between the rotation axis of the first support roll and the rotation axis of the second support roll.

The continuous hot-dip plating machine according to the above aspect of the invention may further include an adjuster configured to adjust a vertical position of the first support roll.

In addition, in order to solve the above problems, a continuous hot-dip plating method according to another aspect of the invention includes: upwardly changing a transfer direction of a steel strip using a sink roll provided in a plating bath; passing the steel strip through between a first support roll and a second support roll, the first support roll being provided in the plating bath at a position above the sink roll and in contact with a first surface of the steel strip in contact with the sink roll, the second support roll being provided in the plating bath at a position above the first support roll and in contact with a second surface of the steel strip opposite the first surface; and adjusting in advance a vertical position of the first support roll so that a diameter of the first support roll, a diameter of the second support roll, and a vertical distance between a rotation axis of the first support roll and a rotation axis of the second support roll satisfy conditions represented by formulae (1) to (4) below,

[Formula 2]

$$D = D2 - 0.376D1 \quad (1)$$

$$420 - 0.839L \leq D \leq 445 - 0.655L \quad (2)$$

$$D1 \geq 210 \quad (3)$$

$$D1 + D2 \leq 1000 - 2L + 2\left(20 - \sqrt{\frac{D1}{2}}\right)^2 \quad (4)$$

where:

D1 represents the diameter (mm) of the first support roll,

D2 represents the diameter (mm) of the second support roll, and

L represents the vertical distance (mm) between the rotation axis of the first support roll and the rotation axis of the second support roll.

According to the above aspects of the invention described above, the scratches and/or defects on the surface of the hot-dip steel strip can be prevented, thereby improving the quality of the hot-dip steel strip.

BRIEF DESCRIPTION OF DRAWING(S)

DESCRIPTION OF EMBODIMENT(S)

Figure 1:
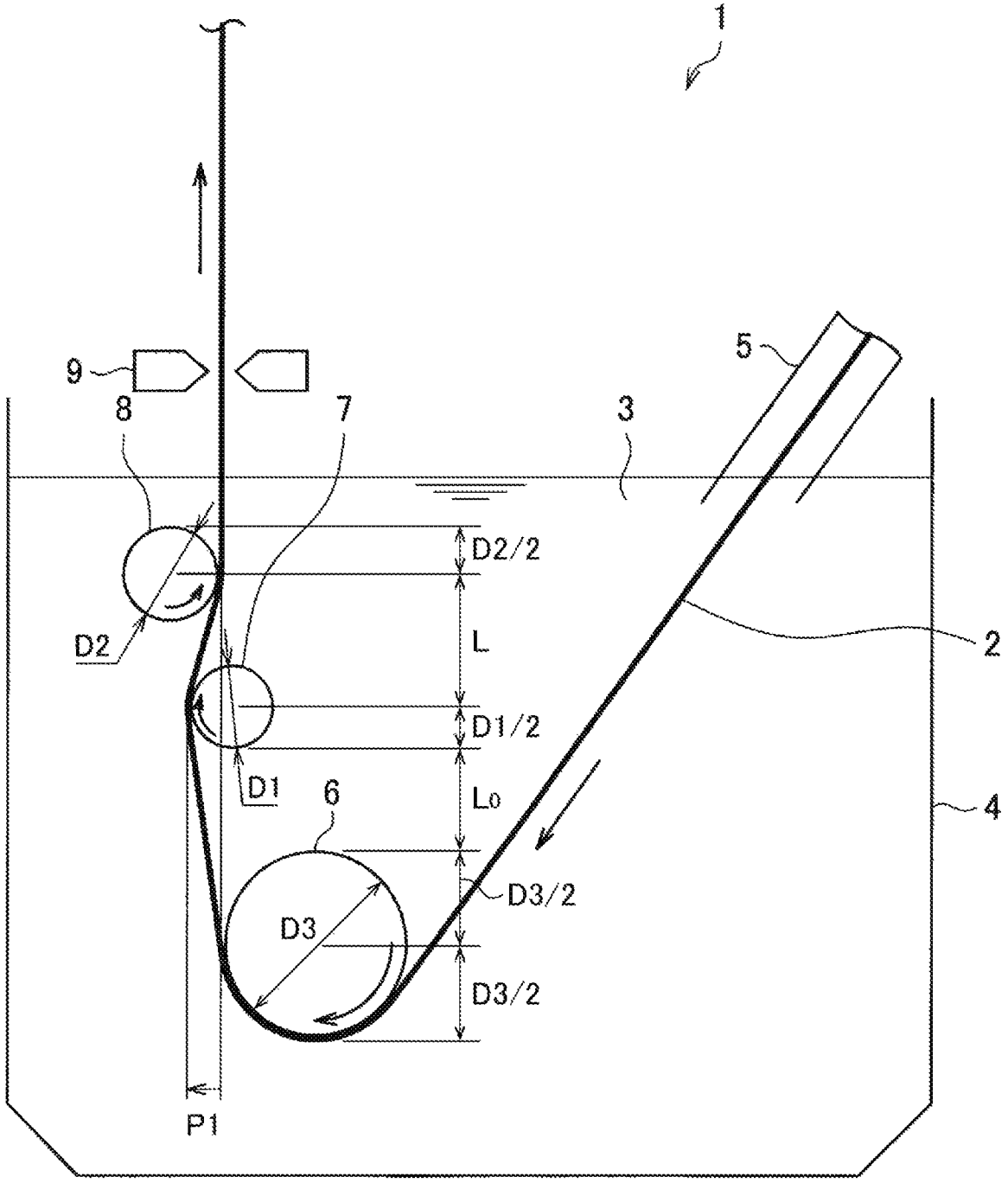
FIG. 1 is a schematic illustration showing an outline of an example of a continuous hot-dip plating machine according to an exemplary embodiment of the invention.

Suitable exemplary embodiment(s) of the invention will be described in detail below with reference to the attached drawings. It should be noted that the same reference numerals will be attached to components having substantially the same structures and functions to omit duplicated explanations therefor in the specification and drawings.

1. Structure of Continuous Hot-Dip Plating Machine

Initially, a structure of a continuous hot-dip plating machine 1 according to an exemplary embodiment of the invention will be described with reference to FIG. 1. FIG. 1 is a schematic illustration showing an outline of an example of the continuous hot-dip plating machine according to the exemplary embodiment.

As shown in FIG. 1, the continuous hot-dip plating machine 1 is an apparatus for immersing a steel strip 2 in a plating bath 3 filled with a molten metal to continuously coat the surface of the steel strip 2 with the molten metal and, subsequently, adjusting a coating weight of the molten metal to a predetermined level. The continuous hot-dip plating machine 1 includes a plating tank 4, a snout 5, a sink roll 6, a first support roll 7, a second support roll 8, and gas wiping nozzles 9.

The steel strip 2 is a metal strip subjected to a plating treatment using the molten metal. Examples of the molten metal in the plating bath 3 include elementary substances of Zn, Al, Sn and Pb, and alloys thereof. The molten metal may further contain, for instance, non-metal element such as Si and P, typical metal element such as Ca, Mg, and Sr, and/or transition metal element such as Ti, V, Cr, Mn, Fe, Co, Ni, and Cu, in addition to the above metal or alloy. In the description below, an example will be described, in which the molten metal of the plating bath 3 is molten zinc and the surface of the steel strip 2 is coated with the molten zinc to produce a galvanized steel sheet.

The plating tank 4 stores the plating bath 3 of the molten metal. The snout 5 is slanted so that an upper end is connected to, for instance, an exit of an annealing furnace and a lower end is immersed in the plating bath 3. The sink roll 6 is provided at a lower side of the plating bath 3. The sink roll 6 has a diameter larger than the diameter of each of the first support roll 7 and the second support roll 8. The sink roll 6 rotates clockwise in conjunction with the transfer of the steel strip 2, thus changing a transfer direction of the steel strip 2, which is diagonally downwardly introduced into the plating bath 3 through the snout 5, to a vertically upward direction. The sink roll 6 may be a non-driven roll.

The first support roll 7 and the second support roll 8 are disposed above the sink roll 6 in the plating bath 3. The first support roll 7 is disposed above the sink roll 6 in the plating bath 3 and is in contact with a first surface (i.e. a surface in contact with the sink roll 6) of the steel strip 2. The second support roll 8 is disposed above the first support roll 7 in the plating bath 3 and is in contact with a second surface of the steel strip 2 opposite the first surface in contact with the sink roll 6. The steel strip 2, whose course is changed by the sink roll 6, is pulled vertically upward to pass through between the first support roll 7 and the second support roll 8. The first support roll 6 may be a non-driven roll. The second support roll 6 may be a non-driven roll or a driven roll.

A depth of the plating bath 3 typical ranges from 2000 mm to 3000 mm. It should be noted that, though the depth of the plating bath 3 may be deeper than the above, a depth exceeding the above range makes it difficult to scoop the dross deposited on the bottom of the bath and increases variation in an in-bath temperature distribution to assist the formation of the dross. A diameter D3 of the sink roll 6 typically ranges from 600 mm to 800 mm.

A horizontal position of the first support roll 7 with respect to the second support roll 8 is appropriately adjusted so that the steel strip 2 passing through between the first support roll 7 and the second support roll 8 is horizontally pushed, thereby eliminating a warpage of the steel strip 2 in the width direction. Thus, the coating weight can be made uniform. Specifically, an offset P1 shown in FIG. 1 (i.e. a horizontal relative distance between a point on the second support roll 8 in contact with the steel strip 2 and a point on the first support roll 7 in contact with the steel strip 2) is set at a value capable of suitably flattening the shape of the steel strip 2. More specifically, the offset P1 is set in a range from 5 mm to 30 mm. Further, the first support roll 7 and the second support roll 8 are also configured to reduce vibrations of the pulled-up steel strip 2. The vibrations caused on the steel strip 2 having passed over the second support roll 8 may cause non-uniform distribution of the coating weight. Accordingly, by reducing the vibrations generated on the pulled-up steel strip 2, the coating weight can be made uniform.

The gas wiping nozzles 9 blow gas (e.g. air and nitrogen gas) on the surface of the steel strip 2 to adjust the coating weight of the molten metal on the steel strip 2. High-pressure gas compressed by a compressor or the like (not shown) is introduced into each of the gas wiping nozzles 9. The gas wiping nozzles 9 are disposed at opposite sides of the steel strip 2 in a thickness direction and at a predetermined height from a bath surface of the plating bath 3 to be above the first support roll 7 and the second support roll 8. The gas from the gas wiping nozzles 9 is blown onto the opposite sides of the steel strip 2 vertically upwardly pulled up from the plating bath 3 to wipe off an extra molten metal. Thus, the coating weight of the molten metal on the surface of the steel strip 2 is regulated to an appropriate amount to adjust the thickness of the molten metal coating.

An operation of the above continuous hot-dip plating machine 1 will be described below. The continuous hot-dip plating machine 1 moves the steel strip 2 through parts in the machine by a drive source (not shown). The steel strip 2 is diagonally downwardly introduced into the plating bath 3 through the snout 5 and brought around the sink roll 6 to change the transfer direction thereof to a vertically upward direction. Subsequently, the steel strip 2 is raised through between the first support roll 7 and the second support roll 8 and pulled up toward an outside of the plating bath 3. Subsequently, the extra molten metal adhered on the steel strip 2 is wiped off by the pressure of the gas blown from the gas wiping nozzles 9 to adjust the deposited mass of the molten metal on the surface of the steel strip 2 to a predetermined coating weight. As described above, the continuous hot-dip plating machine 1 successively immerses the steel strip 2 in the plating bath 3 to coat the steel strip 2 with the molten metal, thereby producing a hot-dip steel sheet of a predetermined coating weight. It should be noted that a travelling speed of the steel strip 2 is set in a range from 60 m/min to 180 m/min.

As described above, in a typical continuous hot-dip plating, scratches and/or defects (e.g. slip scratches, roll scratches and dross defects) sometimes occur on the surface of the hot-dip steel strip. The continuous hot-dip plating machine 1 according to the exemplary embodiment prevents the scratches and/or defects on the surface of the hot-dip steel strip by setting the diameter D1 of the first support roll 7, the diameter D2 of the second support roll 8, and the vertical distance L between the rotation axis of the first support roll 7 and the rotation axis of the second support roll 8 to satisfy specific conditions described below. Thus, the quality of the hot-dip steel strip can be improved. It should be noted that the distance L may be specifically set at 160 mm or more. Preferably, the distance L is in a range from 175 mm to 275 mm.

2. Setting of Diameter of First Support Roll and Diameter of Second Support Roll Subsequently, the setting of the diameter D1 of the first support roll 7 and the diameter D2 of the second support roll 8 of the continuous hot-dip plating machine 1 of the exemplary embodiment, which is dependent on the vertical distance L between the rotation axis of the first support roll 7 and the rotation axis of the second support roll 8, will be described below with reference to FIGS. 2 to 7.

In the continuous hot-dip plating machine 1 according to the exemplary embodiment, the diameter D1 of the first support roll 7, the diameter D2 of the second support roll 8, and the vertical distance L between the rotation axis of the first support roll 7 and the rotation axis of the second support roll 8 are set to satisfy the conditions represented by formulae (1) to (4) below.

It should be noted the diameter D1 of the first support roll 7, the diameter D2 of the second support roll 8, and the vertical distance L between the rotation axis of the first support roll 7 and the rotation axis of the second support roll 8 are all defined in millimeter (mm) unit.

[Formula 3]

$$D = D2 - 0.376D1 \tag{1}$$

$$420 - 0.839L \le D \le 445 - 0.655L \tag{2}$$

$$D1 \ge 210 \tag{3}$$

$$D1 + D2 \le 1000 - 2L + 2\left(20 - \sqrt{\frac{D1}{2}}\right)^2 \tag{4}$$

The following formulae (5) and (6) are derived by organizing a formula obtained by assigning D in the formula (1) into the formula (2).

[Formula 4]

$$D2 \le 0.376D1 + 445 - 0.655L \tag{5}$$

$$D2 \ge 0.376D1 + 420 - 0.839L \tag{6}$$

Further, the following formula (7) is derived by organizing the formula (4).

[Formula 5]

$$D2 \leq -80\sqrt{\frac{D1}{2}} - 2L + 1800 \tag{7}$$

Figure 2:
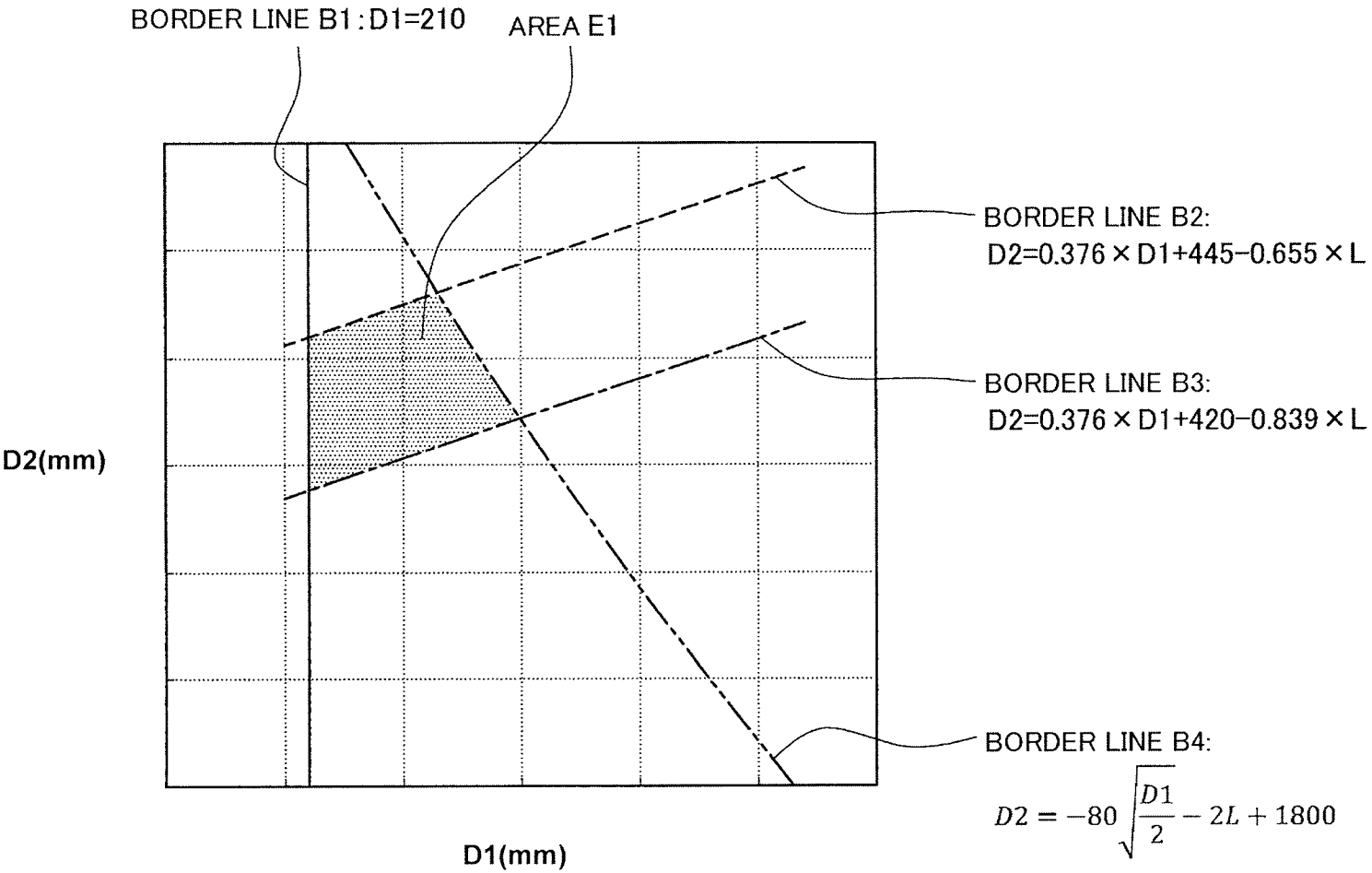
FIG. 2 is an illustration showing a relationship between a diameter D1 of a first support roll, a diameter D2 of a second support roll, and a vertical distance L between a rotation axis of the first support roll and a rotation axis of the second support roll in the exemplary embodiment.

FIG. 2 is an illustration showing a relationship between the diameter D1 of the first support roll 7, the diameter D2 of the second support roll 8, and the vertical distance L between the rotation axis of the first support roll 7 and the rotation axis of the second support roll 8. Referring to FIG. 2, border lines B1 to B4 show a range of an area defined by the formulae (3), (5), (6), and (7) in a D1-D2 plane. It should be noted that the border lines B1 to B4 are respectively represented by formulae (8) to (11) below.

[Formula 6]

$$D1 = 210 \tag{8}$$

$$D2 = 0.376D1 + 445 - 0.655L \tag{9}$$

$$D2 = 0.376D1 + 420 - 0.839L \tag{10}$$

$$D2 = -80\sqrt{\frac{D1}{2}} - 2L + 1800 \tag{11}$$

As shown in FIG. 2, an area E1 surrounded by the border lines B1 to B4 in the D1-D2 plane shows set values of the diameter D1 and the diameter D2 that can be set depending on the distance L. In the continuous hot-dip plating machine 1 according to the exemplary embodiment, the diameter D1 and the diameter D2 are set within the range of the area E1 shown in FIG. 2.

As shown in the formula (3), the diameter D1 of the first support roll 7 is set at 210 mm or more in order to prevent the slip scratches. The diameter D1 of the first support roll 7 is preferably in a range from 220 mm to 250 mm.

When the diameter D2 of the second support roll 8 is excessively large relative to the diameter D1 of the first support roll 7, the offset P1 of the first support roll 7 for eliminating C-warpage becomes so large that the roll scratches by the dross transfer are increased. Accordingly, the upper limit of the diameter D2 of the second support roll 8 is defined as in the formula (5).

When the diameter D2 of the second support roll 8 is excessively small relative to the diameter D1 of the first support roll 7, the dross becomes likely to be caught, so that the dross defects are increased. Accordingly, the lower limit of the diameter D2 of the second support roll 8 is defined as in the formula (6).

Next, the formula (7) is derived as follows.

In order to prevent the dross defects due to the dross at the bottom of the plating bath 3, the vertical distance between the lower end of the sink roll 6 and the upper end of the second support roll 8 is preferably 1500 mm or less.

Specifically, as shown in FIG. 1, it is necessary for the diameter D1 of the first support roll 7, the diameter D2 of the second support roll 8, the diameter D3 of the sink roll 6, the vertical distance L between the rotation axis of the first support roll 7 and the rotation axis of the second support roll 8, and an inter-roll distance $L_0$ between the upper end of the sink roll 6 and the lower end of the first support roll 7 to satisfy the conditions represented by a formula (12) below.

[Formula 7]

$$\frac{D2}{2} + L + \frac{D1}{2} + L_0 + D3 \leq 1500 \tag{12}$$

A formula (13) is obtained by modifying the formula (12).

[Formula 8]

$$\frac{D1}{2} + L_0 + \frac{D3}{2} \leq 1500 - \frac{D2}{2} - L - \frac{D3}{2} \tag{13}$$

Figure 3:
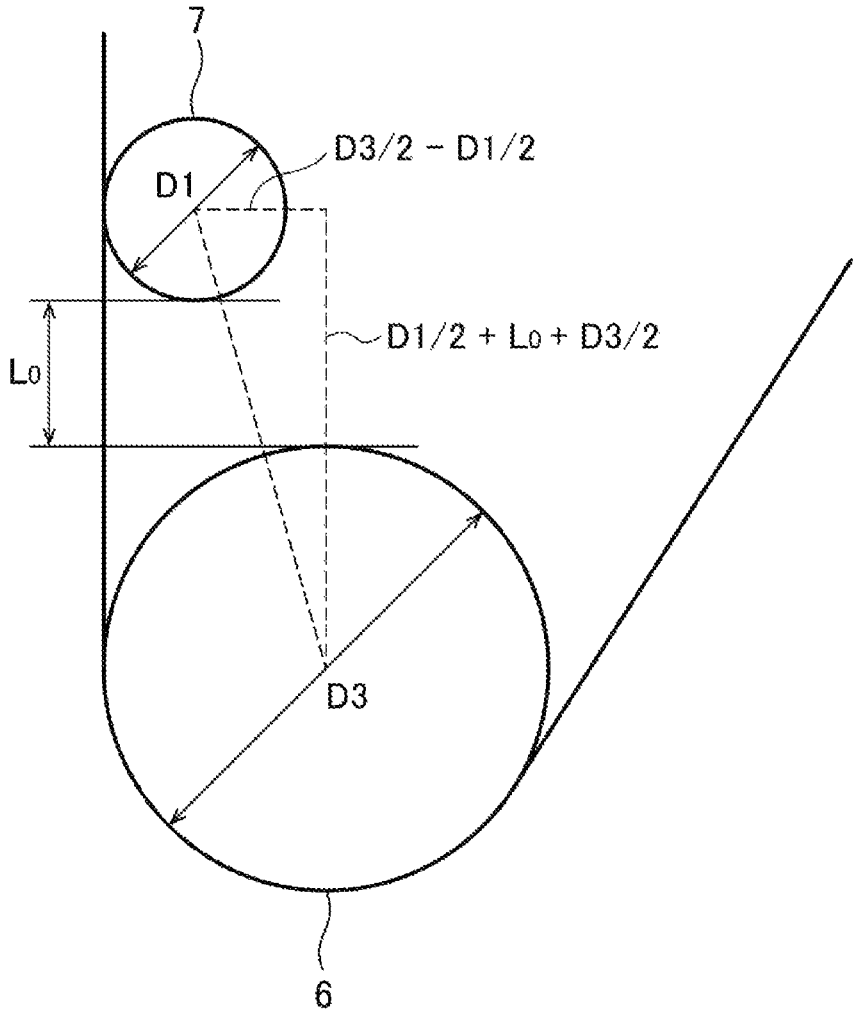
FIG. 3 is a schematic illustration showing conditions for preventing the first support roll from contacting the sink roll in the exemplary embodiment.

Next, as shown in FIG. 3, a condition for the sink roll 6 to be in contact with the first support roll 7 is represented by a formula (14) below.

[Formula 9]

$$\left(\frac{D1}{2} + L_0 + \frac{D3}{2}\right)^2 + \left(\frac{D3}{2} - \frac{D1}{2}\right)^2 = \left(\frac{D1}{2} + \frac{D3}{2}\right)^2 \tag{14}$$

A formula (15) is obtained by organizing both sides of the formula (14).

[Formula 10]

$$\frac{D1}{2} + L_0 + \frac{D3}{2} = \sqrt{D1 \cdot D3} \tag{15}$$

When the sink roll 6 and the first support roll 7 are too close to each other, a circulating flow is generated in an area surrounded by the steel strip 2, the sink roll 6 and the first support roll 7, where the dross is likely to be accumulated and grown. Accordingly, it is necessary to keep a predetermined distance between the sink roll 6 and the first support roll 7. After researches made by the inventors under various conditions, it has been found that additional 200 mm or more of the inter-roll distance $L_0$ should be preferably kept in vertical direction from a contact condition represented by the formula (15) in order to prevent the dross defects. Accordingly, it is necessary for the inter-roll distance $L_0$ between the upper end of the sink roll 6 and the first support roll 7 to satisfy the condition represented by a formula (16) below.

[Formula 11]

$$L_0 \geq \sqrt{D1 \cdot D3} - \frac{D1}{2} - \frac{D3}{2} + 200 \tag{16}$$

The following formula (17) is obtained by assigning the minimum inter-roll distance $L_0$ satisfying the formula (16) into the formula (12).

[Formula 12]

$$\sqrt{D1 \cdot D3} \leq 1300 - \frac{D2}{2} - L - \frac{D3}{2} \quad (17)$$

Based on the formula (17), the diameter D2 of the second support roll 8 falls within a range defined by the following formula (18).

[Formula 13]

$$D2 \leq -2\sqrt{D1 \cdot D3} - 2L + 2600 - D3 \quad (18)$$

Since the diameter D3 of the sink roll 6 is 800 mm at the maximum, the diameter D2 of the second support roll 8 corresponding to the maximum diameter of the sink roll 6 is in the range defined by the formula (19). It should be noted that, as can be understood from the formula (18), the possible range of the diameter D2 of the second support roll 8 becomes wider as the diameter D3 of the sink roll 6 becomes smaller.

[Formula 14]

$$D2 \leq -80\sqrt{\frac{D1}{2}} - 2L + 1800 \quad (19)$$

The meaning of each of the formulae (3), (5), (6) and (7) defining the range of the area E1 will be explained below with reference to reference examples that are different from the exemplary embodiment.

Figure 4:
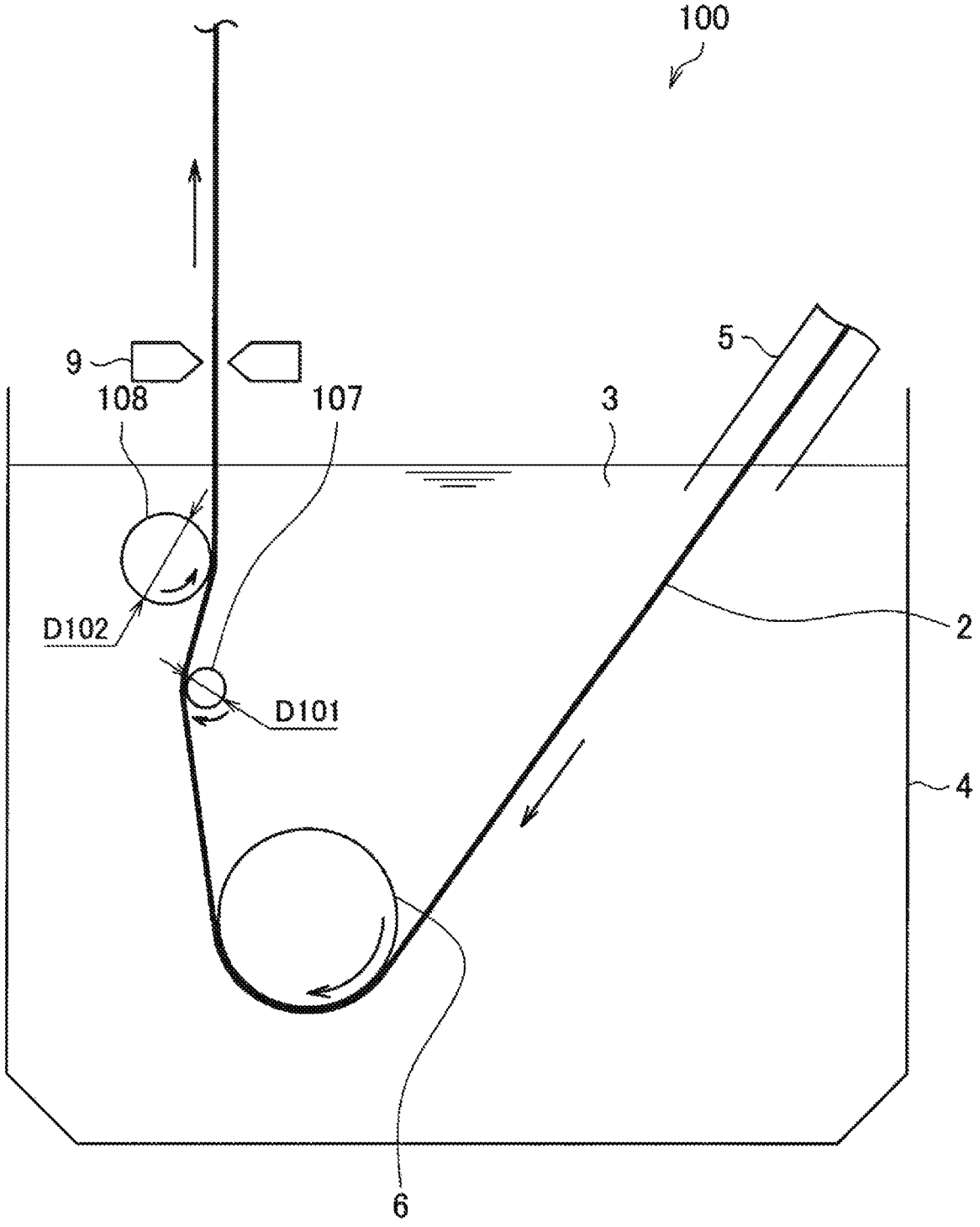
FIG. 4 is a schematic illustration showing an outline of an example of a continuous hot-dip plating machine according to a first reference example.

FIG. 4 is a schematic illustration showing an outline of an example of a continuous hot-dip plating machine 100 according to a first reference example. A diameter D101 of a first support roll 107 and a diameter D102 of a second support roll 108 of the continuous hot-dip plating machine 100 are set at values not satisfying the formula (3). In other words, the diameter D101 of the first support roll 107 and the diameter D102 of the second support roll 108 in the first reference example are defined at values in an area at the left of the border line B1 in the D1-D2 plane shown in FIG. 2.

As shown in FIG. 4, the diameter D101 of the first support roll 107 of the first reference example is small as compared with that of the continuous hot-dip plating machine 1 according to the exemplary embodiment shown in FIG. 1. As the diameter D101 of the first support roll 107 becomes small, a contact area between the first support roll 107 and the steel strip 2 is reduced. Thus, with a torque applied to the first support roll 107 being reduced, the rotation of the first support roll 107 may fail, thereby causing the slip scratches on the steel strip 2.

Figure 5:
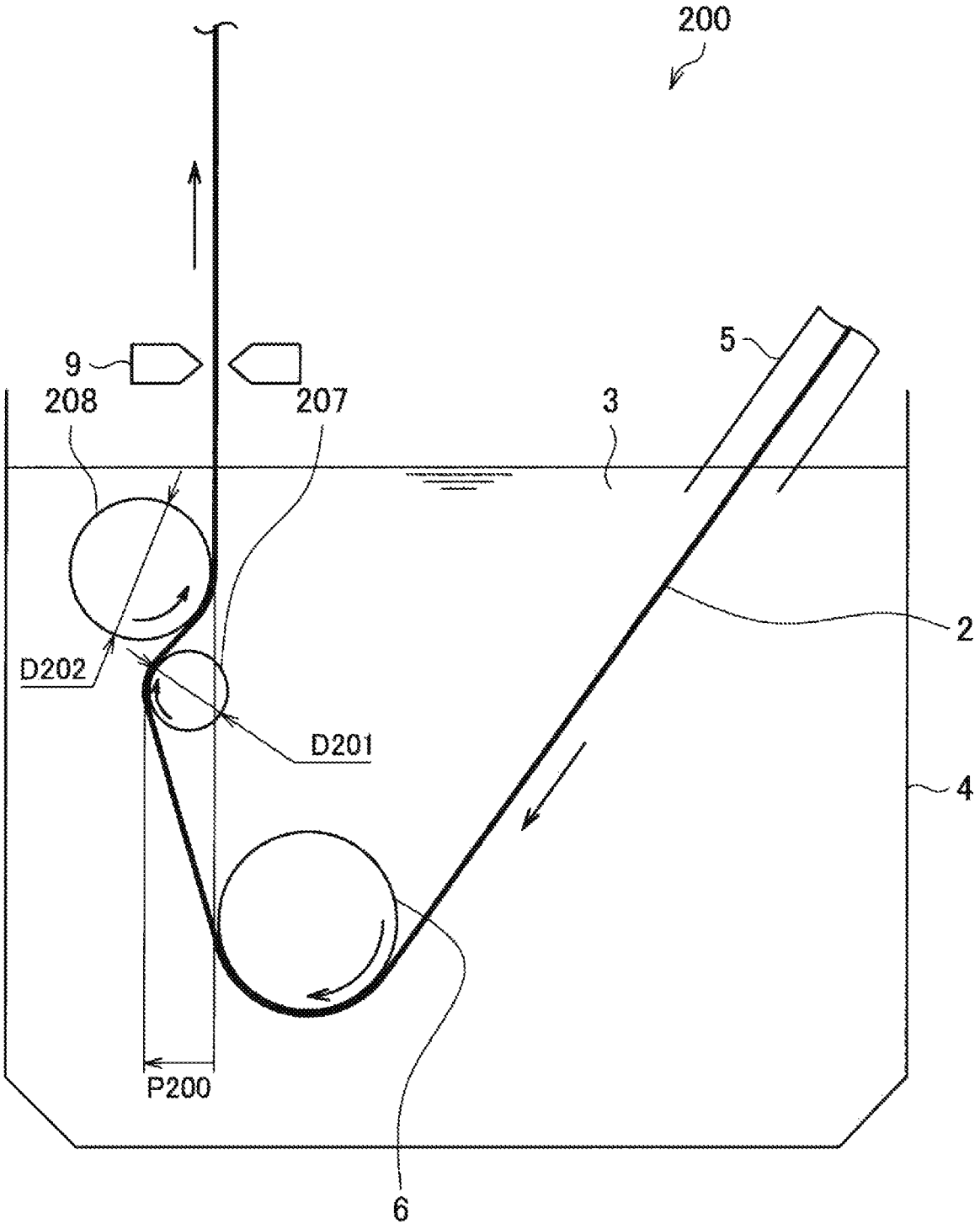
FIG. 5 is a schematic illustration showing an outline of an example of a continuous hot-dip plating machine according to a second reference example.

FIG. 5 is a schematic illustration showing an outline of an example of a continuous hot-dip plating machine 200 according to a second reference example. A diameter D201 of a first support roll 207 and a diameter D202 of a second support roll 208 of the continuous hot-dip plating machine 200 are set at values not satisfying the formula (5). In other words, the diameter D201 of the first support roll 207 and the diameter D202 of the second support roll 208 in the second reference example are defined at values in an area above the border line B2 in the D1-D2 plane shown in FIG. 2.

As shown in FIG. 5, the diameter D202 of the second support roll 208 of the second reference example is large as compared with that of the continuous hot-dip plating machine 1 according to the exemplary embodiment shown in FIG. 1. As the diameter D202 of the second support roll 208 becomes large, the effect for eliminating the warpage of the steel strip 2 in the width direction is reduced, so that it is necessary to shift the first support roll 207 toward the side of the second support roll 208. Accordingly, an offset P200 of the second reference example is large as compared with that of the continuous hot-dip plating machine 1 according to the exemplary embodiment shown in FIG. 1. Thus, the roll scratches may occur by a transfer of the dross adhered on the first support roll 207 and/or the second support roll 208 to the steel strip 2.

Figure 6:
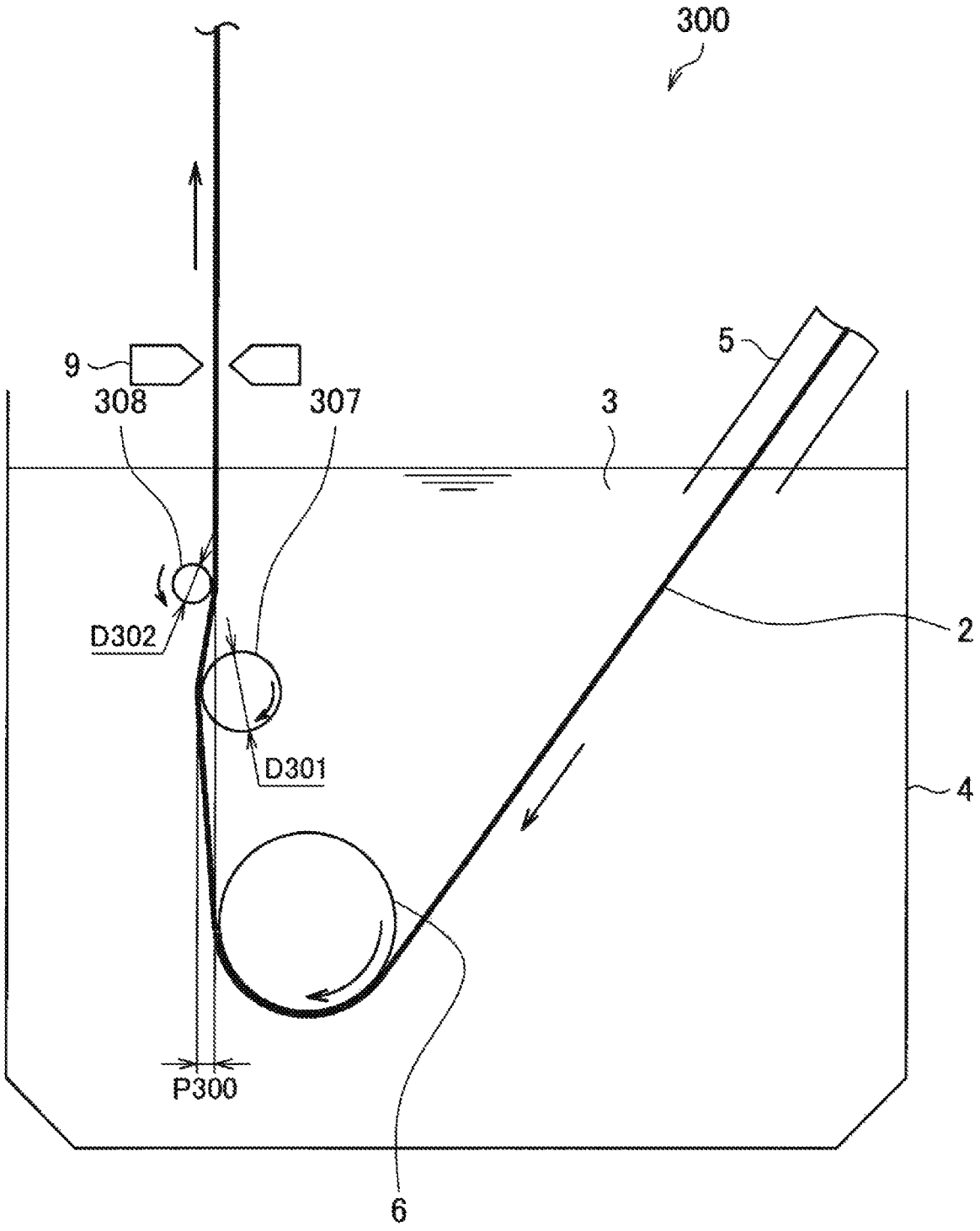
FIG. 6 is a schematic illustration showing an outline of an example of a continuous hot-dip plating machine according to a third reference example.

FIG. 6 is a schematic illustration showing an outline of an example of a continuous hot-dip plating machine 300 according to a third reference example. A diameter D301 of a first support roll 307 and a diameter D302 of a second support roll 308 of the continuous hot-dip plating machine 300 are set at values not satisfying the formula (6). In other words, the diameter D301 of the first support roll 307 and the diameter D302 of the second support roll 308 in the third reference example are defined at values in an area below the border line B3 in the D1-D2 plane shown in FIG. 2.

As shown in FIG. 6, the diameter D302 of the second support roll 308 of the third reference example is small as compared with that of the continuous hot-dip plating machine 1 according to the exemplary embodiment shown in FIG. 1. As the diameter D302 of the second support roll 308 is reduced, the effect for eliminating the warpage of the steel strip 2 in the width direction increases, so that it is necessary to shift the first support roll 307 toward a side away from the second support roll 308. Accordingly, an offset P300 of the third reference example is small as compared with that of the continuous hot-dip plating machine 1 according to the exemplary embodiment shown in FIG. 1. Thus, the dross generated in the plating bath 3 becomes likely to be caught between the first support roll 307 and the steel strip 2 to cause the dross defects due to adhesion of the dross to the steel strip 2.

Figure 7:
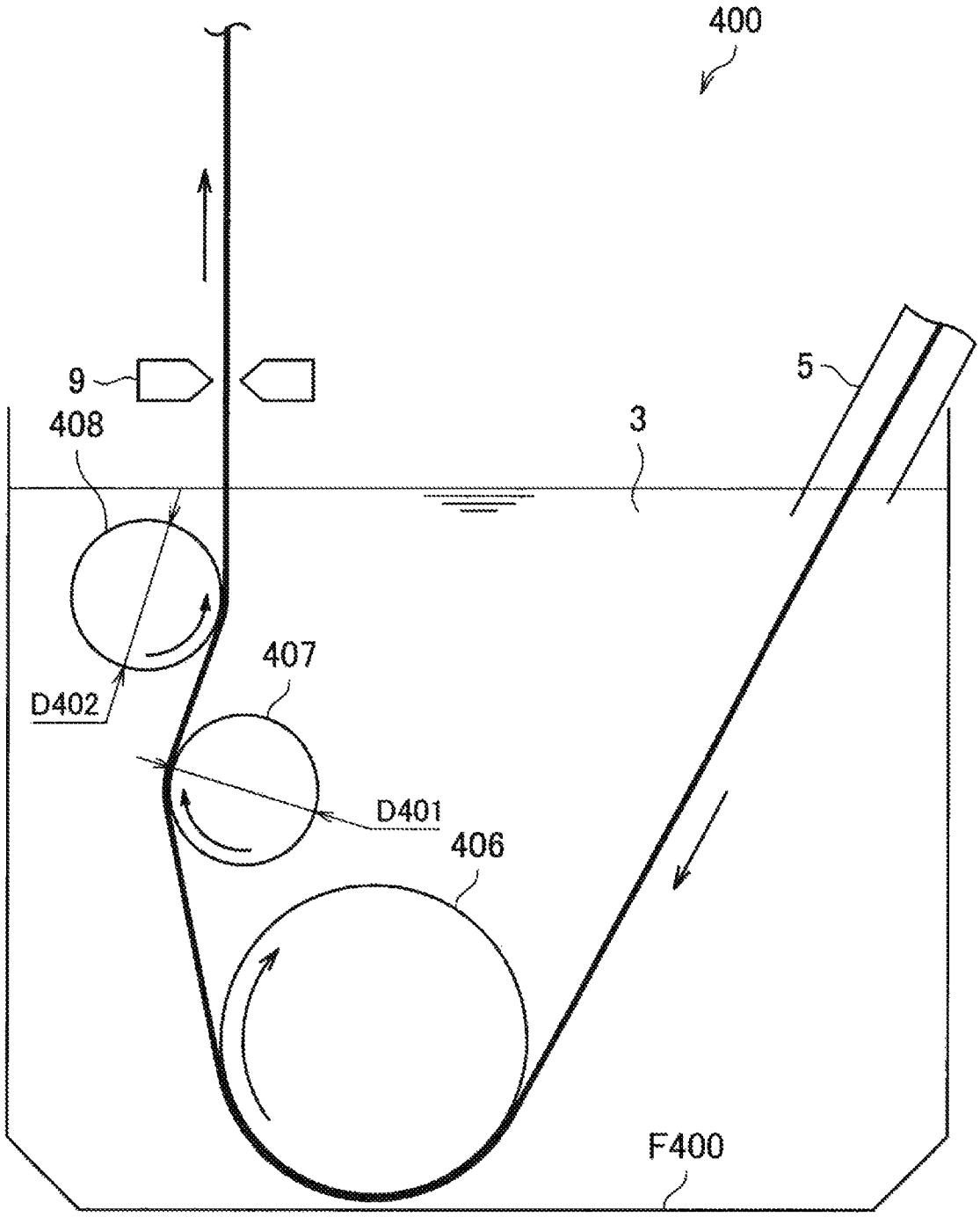
FIG. 7 is a schematic illustration showing an outline of an example of a continuous hot-dip plating machine according to a fourth reference example.

FIG. 7 is a schematic illustration showing an outline of an example of a continuous hot-dip plating machine 400 according to a fourth reference example. A diameter D401 of a first support roll 407 and a diameter D402 of a second support roll 408 of the continuous hot-dip plating machine 400 are set at values not satisfying the formula (7). In other words, the diameter D401 of the first support roll 407 and the diameter D402 of the second support roll 408 in the fourth reference example are defined at values in an area at the upper right of the border line B4 in the D1-D2 plane shown in FIG. 2.

As shown in FIG. 7, the diameter D401 of the first support roll 407 and the diameter D402 of the second support roll 408 of the fourth reference example are large as compared with that of the continuous hot-dip plating machine 1 according to the exemplary embodiment shown in FIG. 1. As the dimensions of the first support roll 407 and the second support roll 408 increase, it becomes necessary to shift the position of the sink roll 406 toward a bottom F400 of the plating tank 4 in order to prevent the rollers from interfering each other. Thus, the dross deposited on the bottom F400 of the plating tank 4 becomes likely to be raised in conjunction with rotations of the sink roll 406. Accordingly, the dross generated in the plating bath 3 is likely to be caught between the first support roll 407 or the second support roll 408 and the steel strip 2, thereby possibly causing the dross defects due to adhesion of the dross on the steel strip 2.

As described above, the diameter D1 of the first support roll 7, the diameter D2 of the second support roll 8, and the vertical distance L between the rotation axis of the first support roll 7 and the rotation axis of the second support roll 8 are defined to satisfy the conditions represented by the formulae (1) to (4) in the continuous hot-dip plating machine 1 according to the exemplary embodiment. Thus, the scratches and/or defects (e.g. the slip scratches, roll scratches, and dross defects) on the surface of the hot-dip steel strip can be prevented, thereby improving the quality of the hot-dip steel strip.

3. Application Example

Next, an application example capable of adjusting a vertical position of the first support roll 7 will be described below with reference to FIG. 8.

Figure 8:
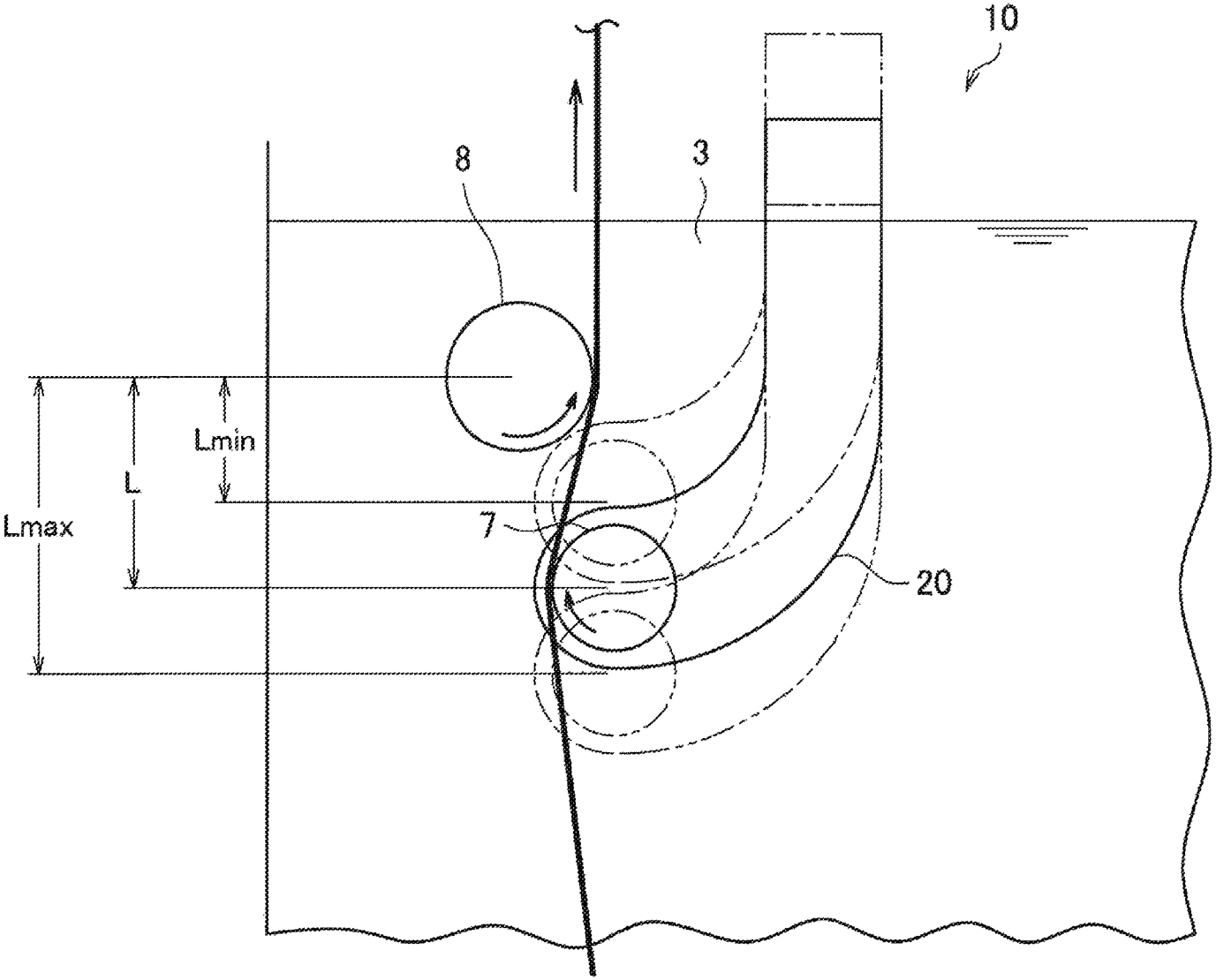
FIG. 8 is a schematic illustration showing an outline of an example of a continuous hot-dip plating machine according to an application example.

FIG. 8 is a schematic illustration showing an outline of an example of a continuous hot-dip plating machine 10 according to an application example. FIG. 8 mainly shows an arrangement of the continuous hot-dip plating machine 10 around the first support roll 7 and the second support roll 8. The continuous hot-dip plating machine 10 according to the application example is different from the continuous hot-dip plating machine 1 according to the exemplary embodiment shown in FIG. 1 in that the continuous hot-dip plating machine 10 includes an adjuster capable of adjusting the vertical position of the first support roll 7.

The function of the adjuster may be achieved by an arm 20 shown in FIG. 8 for holding the first support roll 7 and a drive device (not shown) for moving the arm 20. The first support roll 7 is rotatably fixed to a lower part of the arm 20. An upper part of the arm 20 protrudes upward from the bath surface of the plating bath 3 to be connected to the drive device (not shown) outside the plating bath 3. The arm 20 is configured to be vertically moved by the drive device to adjust the vertical position of the arm 20, thereby adjusting the vertical position of the first support roll 7. It should be noted that the arm 20 may alternatively be configured to be horizontally moved by the drive device.

With the use of the adjuster of the application example, the vertical distance L between the rotation axis of the first support roll 7 and the rotation axis of the second support roll 8 can be adjusted by adjusting the vertical position of the first support roll 7. For instance, when the arm 20 is positioned at the lowermost part in a movable range as shown in FIG. 8, the distance L is at a maximum value Lmax. In contrast, when the arm 20 is positioned at the uppermost part in the movable range, the distance L is at a minimum value Lmin. In this arrangement, the distance L is adjustable in a range between Lmin to Lmax. Accordingly, when Lmin and Lmax are appropriately defined, the vertical position of the first support roll 7 can be adjusted in advance so that the diameter D1 of the first support roll 7, the diameter D2 of the second support roll 8, and the vertical distance L between the rotation axis of the first support roll 7 and the rotation axis of the second support roll 8 satisfy the conditions represented by the formulae (1) to (4).

A continuous hot-dip plating method using the continuous hot-dip plating machine 10 according to the above application example will be described below. The continuous hot-dip plating method includes: a step for adjusting the vertical position of the first support roll 7 in advance; a step for upwardly changing the transfer direction of the steel strip 2 using the sink roll 6; and passing the steel strip 2 through between the first support roll 7 and the second support roll 8. In the step for adjusting the vertical position of the first support roll 7 in advance, the vertical position of the first support roll 7 is adjusted in advance so that the diameter D1, the diameter D2, and the distance L satisfy the conditions represented by the formulae (1) to (4). According to the continuous hot-dip plating method, even when the diameter of at least one of the first support roll 7 and the second support roll 8 is reduced due to abrasion and/or re-polishing, the relationship between the diameter D1, the diameter D2, and the distance L satisfying the conditions represented by the formulae (1) to (4) can be maintained. In this case, it is preferable that the position of the arm 20 is controlled by a controller at a position for the diameter D1, the diameter D2, and the distance L to satisfy the conditions represented by the formulae (1) to (4) depending on the reduction in the diameter of the first support roll 7 and/or the second support roll 8.

Example(s)

In order to demonstrate the effect of the invention, the scratches and/or defects on the surface of the hot-dip steel strips after being subjected to continuous hot-dip plating tests, in which the diameter D1 of the first support roll 7 and the diameter D2 of the second support roll 8 were set at various set values, were evaluated. In the plating tests for the evaluation, the transfer speed of the steel strip 2 was set at 180 m/min, molten zinc was used as the molten metal of the plating bath 3, and cold-rolled carbon steel coil (thickness: from 0.6 mm to 0.7 mm, width: from 950 mm to 1820 mm, carbon content: 0.6% or less) was used as the steel strip 2.

For the evaluation, eighty coils were subjected to the continuous hot-dip under the above test conditions and the slip scratches, the roll scratches, and the dross defects were each visually evaluated as the scratches and/or defects on the surface of the hot-dip steel strip. The slip scratches were evaluated to be acceptable when a ratio of coils having the slip scratches on the hot-dip steel strip to the eighty coils was less than 3% and unacceptable when the ratio was 3% or more. The roll scratches were evaluated to be acceptable when a ratio of coils having the roll scratches on the hot-dip steel strip to the eighty coils was less than 3% and unacceptable when the ratio was 3% or more. The dross defects were evaluated to be acceptable when a ratio of coils having the dross defects on the hot-dip steel strip to the eighty coils was less than 3% and unacceptable when the ratio was 3% or more. It should be noted that, in Tables below showing evaluation results for the scratches and/or defects, an instance in which the ratio of the coil(s) having the scratches and/or defects was less than 1.5% is indicated as A, an instance in which the ratio of the coil(s) having the scratches and/or defects was 1.5% or more and less than 3% is indicated as B, and an instance in which the ratio of the coil(s) having the scratches and/or defects was 3% or more is indicated as C. A and B are ranked acceptable, and C is ranked unacceptable.

It should also be noted that the offset P1 was set so that the coating weight became uniform in Examples and Comparatives below. The uniformity of the coating weight was evaluated by: irradiating a running hot-dip steel strip with gamma ray; and measuring a plating deposited mass in a width direction by detecting an intensity of received fluorescent X-ray.

Initially, the evaluation results on the scratches and/or defects on the surface of the hot-dip steel strips according to Examples 1 to 8 and Comparatives 1 to 8, in which the distance L was set at 200 mm and the diameter D1 of the first support roll 7 and the diameter D2 of the second support roll 8 were set at various set values, are shown in Table 1 below.

TABLE 1

| | Dot. No. | D1 [mm] | D2 [mm] | Slip Scratches | Roll Scratches | Dross Defects | Total |
|---|---|---|---|---|---|---|---|
| Ex. 1 | J1 | 220 | 340 | B | A | A | Excellent |
| Ex. 2 | J2 | 220 | 380 | B | A | A | Excellent |
| Ex. 3 | J3 | 230 | 390 | A | B | A | Excellent |
| Ex. 4 | J4 | 280 | 410 | A | B | A | Excellent |
| Ex. 5 | J5 | 240 | 350 | A | A | B | Excellent |
| Ex. 6 | J6 | 300 | 370 | A | A | B | Excellent |
| Ex. 7 | J7 | 310 | 380 | A | A | A | Excellent |
| Ex. 8 | J8 | 300 | 410 | A | A | B | Excellent |
| Comp. 1 | K1 | 190 | 330 | C | A | B | Partly unacceptable |
| Comp. 2 | K2 | 190 | 370 | C | A | A | Partly unacceptable |
| Comp. 3 | K3 | 220 | 410 | A | C | A | Partly unacceptable |
| Comp. 4 | K4 | 280 | 430 | A | C | B | Partly unacceptable |
| Comp. 5 | K5 | 240 | 320 | A | A | C | Partly unacceptable |
| Comp. 6 | K6 | 310 | 340 | A | A | C | Partly unacceptable |
| Comp. 7 | K7 | 330 | 390 | A | A | C | Partly unacceptable |
| Comp. 8 | K8 | 310 | 420 | A | B | C | Partly unacceptable |

Figure 9:
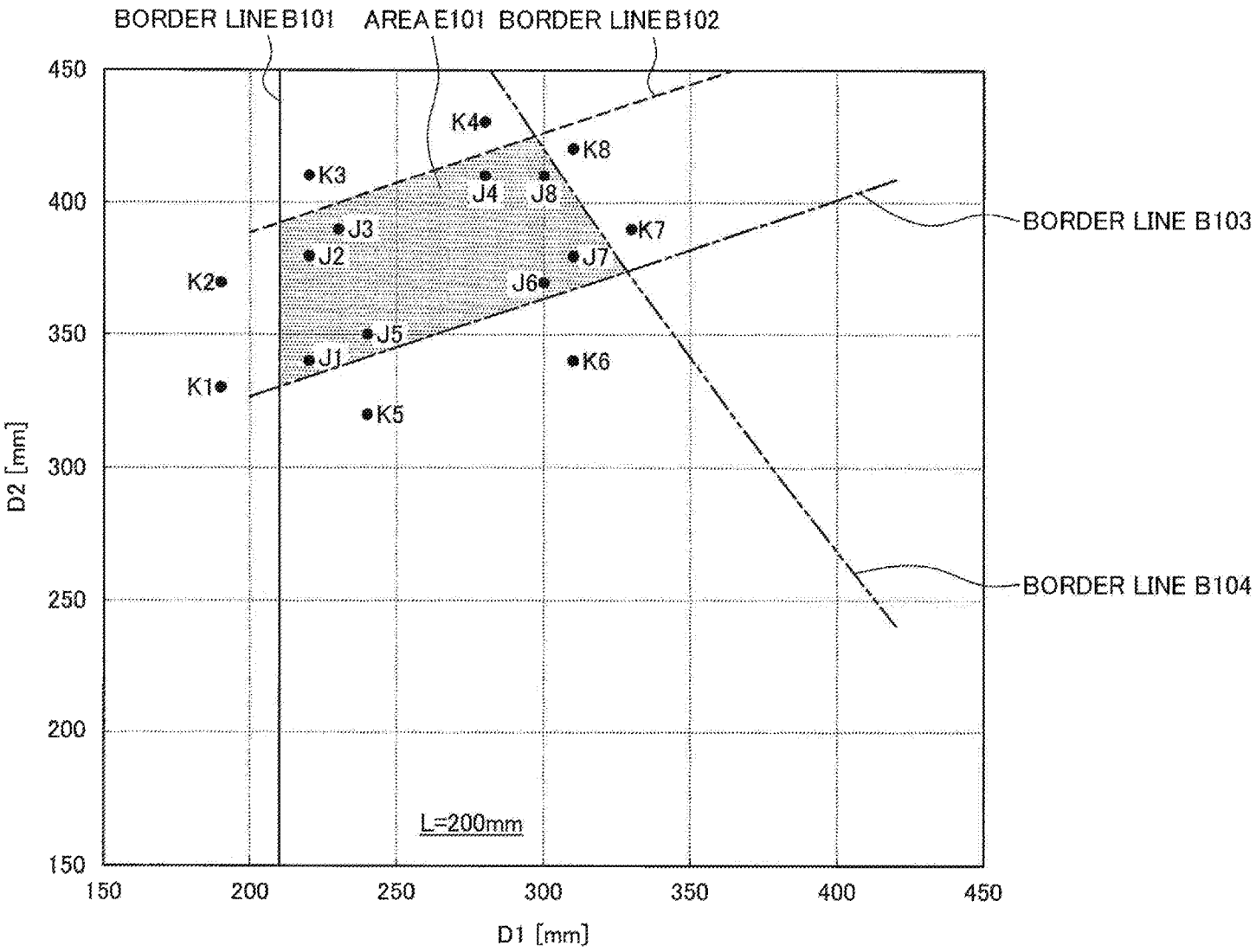
FIG. 9 is an illustration showing various set values in Examples and Comparatives.

FIG. 9 shows dots J1 to J8 respectively corresponding to the set values for the diameter D1 and the diameter D2 of Examples 1 to 8 in the D1-D2 plane, and dots K1 to K8 respectively corresponding to the set values for the diameter D1 and the diameter D2 of Comparatives 1 to 8. Further, FIG. 9 shows border lines B101 to B104 respectively represented by the formulae (8) to (11) when the distance L is set at 200 mm.

As shown in FIG. 9, the dots J1 to J8 respectively corresponding to the set values for the diameters D1 and D2 of Examples 1 to 8 are located within an area E101 surrounded by the border lines B101 to B104 in the D1-D2 plane. Thus, since the diameters D1 and D2 are defined within the area E101 in Examples 1 to 8, the diameter D1, the diameter D2, and the distance L satisfy the conditions represented by the formulae (1) to (4). As shown in Table 1, Examples 1 to 8 are evaluated to be acceptable in terms of all of the slip scratches, the roll scratches and the dross defects, where it is found that the slip scratches, the roll scratches, and the dross defects are prevented.

In contrast, as shown in FIG. 9, the dots K1 to K8 respectively corresponding to the set values for the diameters D1 and D2 of Comparatives 1 to 8 are outside the area E101. Thus, since the diameters D1 and D2 are defined outside the area E101 in Comparatives 1 to 8, the diameter D1, the diameter D2, and the distance L do not satisfy the conditions represented by the formulae (1) to (4).

As shown in Table 1, Comparatives 1 and 2 are evaluated to be unacceptable in terms of the slip scratches, where it is found that a considerable number of slip scratches occur. The dots K1 and K2 respectively corresponding to the set values for the diameters D1 and D2 of Comparatives 1 and 2 are within an area at the left of the border line B101. Accordingly, as described with reference to FIG. 4, it is believed that the slip scratches occur on the steel strip 2 due to rotation failure of the first support roll 7.

As shown in Table 1, Comparatives 3 and 4 are evaluated to be unacceptable in terms of the roll scratches, where it is found that a considerable number of roll scratches occur. The dots K3 and K4 respectively corresponding to the set values for the diameters D1 and D2 of Comparatives 3 and 4 are within an area above the border line B102. Thus, as described with reference to FIG. 5, it is believed that the roll scratches occur by the transfer of the dross adhered on the first support roll 7 and/or the second support roll 8 to the steel strip 2.

As shown in Table 1, Comparatives 5 and 6 are evaluated to be unacceptable in terms of the dross defects, where it is found that considerable number of dross defects occur. The dots K5 and K6 respectively corresponding to the set values for the diameters D1 and D2 of Comparatives 5 and 6 are within an area below the border line B103. As described with reference to FIG. 6, it is believed that the dross defects occur by the dross caught between the first support roll 7 and the steel strip 2.

As shown in Table 1, Comparatives 7 and 8 are evaluated to be unacceptable in terms of the dross defects, where it is found that a considerable number of dross defects occur. The dots K7 and K8 respectively corresponding to the set values for the diameters D1 and D2 of Comparatives 7 and 8 are located in an area at the upper right of the border line B104. As described with reference to FIG. 7, it is believed that the dross defects occur by the dross caught between the first support roll 7 (or the second support roll 8) and the steel strip 2.

Next, the evaluation results on the scratches and/or defects on the surface of the hot-dip steel strips according to Examples 9 to 16 and Comparatives 9 to 16, in which the distance L was set at 300 mm and the diameter D1 of the first support roll 7 and the diameter D2 of the second support roll 8 were set at various set values, are shown in Table 2 below.

TABLE 2

| | Dot. No. | D1 [mm] | D2 [mm] | Slip Scratches | Roll Scratches | Dross Defects | Total |
|---|---|---|---|---|---|---|---|
| Ex. 9 | J9 | 220 | 270 | B | A | A | Excellent |
| Ex. 10 | J10 | 220 | 300 | B | A | A | Excellent |
| Ex. 11 | J11 | 220 | 320 | B | B | A | Excellent |
| Ex. 12 | J12 | 230 | 330 | A | B | A | Excellent |
| Ex. 13 | J13 | 230 | 260 | A | A | B | Excellent |
| Ex. 14 | J14 | 260 | 270 | A | A | B | Excellent |
| Ex. 15 | J15 | 260 | 280 | A | A | B | Excellent |
| Ex. 16 | J16 | 240 | 310 | A | A | B | Excellent |
| Comp. 9 | K9 | 190 | 260 | C | A | A | Partly unacceptable |
| Comp. 10 | K10 | 190 | 300 | C | A | A | Partly unacceptable |
| Comp. 11 | K11 | 200 | 340 | C | C | A | Partly unacceptable |
| Comp. 12 | K12 | 220 | 340 | A | C | B | Partly unacceptable |
| Comp. 13 | K13 | 220 | 230 | A | A | C | Partly unacceptable |
| Comp. 14 | K14 | 260 | 240 | A | A | C | Partly unacceptable |
| Comp. 15 | K15 | 270 | 290 | A | A | C | Partly unacceptable |
| Comp. 16 | K16 | 250 | 330 | A | A | C | Partly unacceptable |

Figure 10:
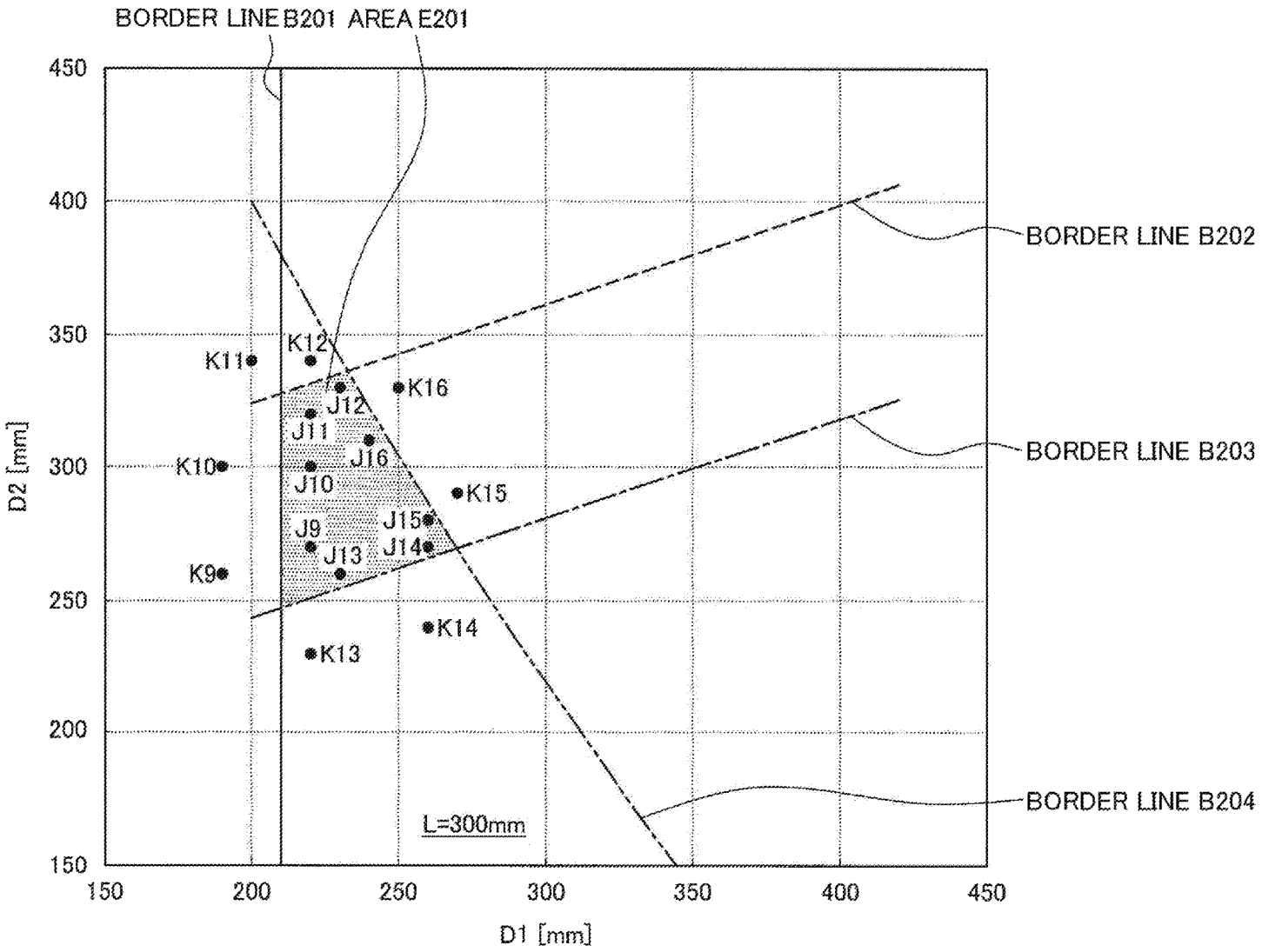
FIG. 10 is another illustration showing various set values in Examples and Comparatives.

FIG. 10 shows dots J9 to J16 respectively corresponding to set values for the diameter D1 and the diameter D2 of Examples 9 to 16 in the D1-D2 plane, and dots K9 to K16 respectively corresponding to set values for the diameter D1 and the diameter D2 of Comparatives 9 to 16. Further, FIG. 10 shows border lines B201 to B204 respectively represented by the formulae (8) to (11) when the distance L is set at 300 mm.

As shown in FIG. 10, the dots J9 to J16 respectively corresponding to the set values for the diameters D1 and D2 of Examples 9 to 16 are located within an area E201 surrounded by the border lines B201 to B204 in the D1-D2 plane. Thus, since the diameters D1 and D2 are defined within the area E201 in Examples 9 to 16, the diameter D1, the diameter D2, and the distance L satisfy the conditions represented by the formulae (1) to (4). As shown in Table 2, Examples 9 to 16 are evaluated to be acceptable for all of the slip scratches, the roll scratches and the dross defects, where it is found that the slip scratches, the roll scratches, and the dross defects are prevented.

In contrast, as shown in FIG. 10, the dots K9 to K16 respectively corresponding to the set values for the diameters D1 and D2 of Comparatives 9 to 16 are outside the area E201. Thus, since the diameters D1 and D2 are defined outside the area E201 in Comparatives 9 to 16, the diameter D1, the diameter D2, and the distance L do not satisfy the conditions represented by the formulae (1) to (4).

As shown in Table 2, Comparatives 9 to 16 are evaluated to be unacceptable in terms of at least one of the slip scratches, the roll scratches, and the dross defects in the same manner as in Comparatives 1 to 8, where it is found that a considerable number of at least one of the slip scratches, the roll scratches, and the dross defects occur. Specifically, as shown in Table 2, Comparatives 9 and 10 are evaluated to be unacceptable in terms of the slip scratches, where it is found that considerable number of slip scratches occur. As shown in Table 2, Comparative 11 is evaluated to be unacceptable in terms of the slip scratches and the roll scratches, where it is found that a considerable number of slip scratches and roll scratches occur. As shown in Table 2, Comparative 12 is evaluated to be unacceptable in terms of the roll scratches, where it is found that considerable number of roll scratches occur. As shown in Table 2, Comparatives 13 to 16 are evaluated to be unacceptable in terms of the dross defects, where it is found that considerable number of dross defects occur.

Based on the above results, it is found that the scratches and/or defects on the surface of the hot-dip steel strip can be reduced by setting the diameter D1 of the first support roll 7, the diameter D2 of the second support roll 8, and the vertical distance L between the rotation axis of the first support roll 7 and the rotation axis of the second support roll 8 to satisfy the conditions represented by the formulae (1) to (4). Accordingly, the quality of the hot-dip steel strip can be improved by the continuous hot-dip plating machine 1 according to the exemplary embodiment.

4. Conclusion

As described above, the diameter D1 of the first support roll 7, the diameter D2 of the second support roll 8, and the vertical distance L between the rotation axis of the first support roll 7 and the rotation axis of the second support roll 8 are set to satisfy the conditions represented by the formulae (1) to (4) in the exemplary embodiment. Accordingly, the scratches and/or defects on the surface of the hot-dip steel strip can be prevented, thereby improving the quality of the hot-dip steel strip.

Though the offset P1 is exemplarily adjusted by adjusting the horizontal position of the first support roll 7 in the above exemplary embodiment, the technical scope of the invention is not limited thereto. For instance, the offset P1 may alternatively be adjusted by adjusting the horizontal position of the second support roll 8 with respect to the first support roll 7. It should however be noted that, in the above arrangement, it is necessary to adjust the horizontal position of the gas wiping nozzles 9 so as to keep the positional relationship between the gas wiping nozzles 9 and the second support roll 8.

Though the adjuster is exemplarily provided by the arm 20 and the drive device for driving the arm 20 in the above exemplary embodiment, the technical scope of the invention is not limited thereto. The adjuster may be provided in a manner different from that in the exemplary embodiment as long as the vertical position of the first support roll 7 is adjustable.

Though the suitable exemplary embodiment has been described in detail with reference to the attached drawings, the invention may be provided in a manner different from the above. It is obvious to those having an ordinary skill in the field of the art to which the invention belongs to reach various modifications and application examples within the range of the technical idea described in claims, and it should be understood that such modifications and application examples are within the technical scope of the invention.

The invention claimed is:

1. A continuous hot-dip plating machine comprising:

a plating bath;

a sink roll provided in the plating bath and configured to upwardly change a transfer direction of a steel strip;

a first support roll provided in the plating bath, the first support roll being positioned above the sink roll and in contact with a first surface of the steel strip in contact with the sink roll; and a second support roll provided in the plating bath, the second support roll being positioned above the first support roll and in contact with a second surface of the steel strip opposite the first surface, wherein a diameter of the first support roll, a diameter of the second support roll, and a vertical distance between a rotation axis of the first support roll and a rotation axis of the second support roll satisfy conditions represented by formulae (1) to (4) below, $$D = D2 - 0.376D1 \quad (1)$$

$$420 - 0.839L \le D \le 445 - 0.655L \quad (2)$$

$$D1 \ge 210 \quad (3)$$

$$D1 + D2 \le 1000 - 2L + 2\left(20 - \sqrt{\frac{D1}{2}}\right)^2 \quad (4)$$

where:

D1 represents the diameter (mm) of the first support roll,

D2 represents the diameter (mm) of the second support roll, and

L represents the vertical distance (mm) between the rotation axis of the first support roll and the rotation axis of the second support roll, and wherein a lower end of the first support roll is spaced apart from an upper end of the sink roll by 200 mm or more.

2. The continuous hot-dip plating machine according to claim 1, further comprising: an adjuster configured to adjust a vertical position of the first support roll.

3. A continuous hot-dip plating method comprising:

upwardly changing a transfer direction of a steel strip using a sink roll provided in a plating bath;

passing the steel strip through between a first support roll and a second support roll, the first support roll being provided in the plating bath at a position above the sink roll and in contact with a first surface of the steel strip in contact with the sink roll, the second support roll being provided in the plating bath at a position above the first support roll and in contact with a second surface of the steel strip opposite the first surface; and adjusting in advance a vertical position of the first support roll so that a diameter of the first support roll, a diameter of the second support roll, and a vertical distance between a rotation axis of the first support roll and a rotation axis of the second support roll satisfy conditions represented by formulae (1) to (4) below, $$D = D2 - 0.376D1 \quad (1)$$

$$420 - 0.839L \le D \le 445 - 0.655L \quad (2)$$

$$D1 \ge 210 \quad (3)$$

$$D1 + D2 \le 1000 - 2L + 2\left(20 - \sqrt{\frac{D1}{2}}\right)^2 \quad (4)$$

where:

D1 represents the diameter (mm) of the first support roll,

D2 represents the diameter (mm) of the second support roll, and

L represents the vertical distance (mm) between the rotation axis of the first support roll and the rotation axis of the second support roll, and wherein a lower end of the first support roll is spaced apart from an upper end of the sink roll by 200 mm or more.

* * * * *